US008231426B2

(12) United States Patent
Miller

(10) Patent No.: US 8,231,426 B2
(45) Date of Patent: Jul. 31, 2012

(54) GEARBOX ASSEMBLY FOR TOY VEHICLE

(75) Inventor: Andrew Kevin Miller, New Territories (HK)

(73) Assignee: Spin Master Ltd., Toronto, Ontario (CA)

( * ) Notice: Subject to any disclaimer, the term of this patent is extended or adjusted under 35 U.S.C. 154(b) by 204 days.

(21) Appl. No.: 12/832,493

(22) Filed: Jul. 8, 2010

(65) Prior Publication Data

US 2012/0009846 A1 Jan. 12, 2012

(51) Int. Cl.
*A63H 31/06* (2006.01)
*A63H 17/00* (2006.01)

(52) U.S. Cl. ..... 446/440; 446/443; 446/456; 446/461; 446/465

(58) Field of Classification Search ..... 446/440–444, 446/456, 461–465, 470; 180/6.2, 6.38, 6.66, 180/6.4, 218–223, 371, 374, 375
See application file for complete search history.

(56) References Cited

U.S. PATENT DOCUMENTS

| | | | | |
|---|---|---|---|---|
| 3,702,037 | A | 11/1972 | Toy et al. | |
| 4,198,049 | A * | 4/1980 | Kurita | 273/119 A |
| 4,201,011 | A | 5/1980 | Cook | |
| 4,580,994 | A | 4/1986 | Fauser et al. | |
| 4,597,744 | A * | 7/1986 | Rehkemper et al. | 446/278 |
| 4,655,724 | A * | 4/1987 | Law | 446/443 |
| 5,019,009 | A | 5/1991 | Chao-Chin et al. | |
| 5,304,088 | A * | 4/1994 | Suimon | 446/443 |
| 5,503,586 | A * | 4/1996 | Suto | 446/443 |
| 5,639,042 | A | 6/1997 | Chiu et al. | |
| 6,540,583 | B1 | 4/2003 | Hoeting et al. | |
| 6,854,547 | B2 * | 2/2005 | Moll et al. | 180/167 |
| 7,234,990 | B2 * | 6/2007 | Leonov et al. | 446/440 |
| 7,578,721 | B1 | 8/2009 | Allmendinger | |

* cited by examiner

*Primary Examiner* — Kien Nguyen
(74) *Attorney, Agent, or Firm* — Cozen O'Connor

(57) ABSTRACT

A gearbox for a toy vehicle is provided that is adapted to transmit rotational power from a motor to a first drivetrain system adapted to drive a wheel and a second drivetrain system adapted to actuate an accessory feature. A swing mechanism is provided to alternatively translate rotational motion from the motor to the first drivetrain or the second drivetrain.

11 Claims, 8 Drawing Sheets

GEARBOX ASSEMBLY FOR TOY VEHICLE

BACKGROUND

The present invention relates to motorized toy vehicles. More specifically, the present invention relates to a gearbox adapted to actuate an accessory feature on a motorized toy vehicle.

Toy vehicles are popular among children. Toy vehicles are often provided with a number of additional features which are intended to increase the enjoyment of playing with the vehicle. For example, toy vehicles are often motorized such that they can be self propelled and are also often radio controlled such that the user can operate the toy vehicle from a remote location.

Furthermore, toy designers often incorporate accessory features that the user can actuate during play. For example, a toy vehicle could be adapted to fire a projectile, open a compartment hatch, extend a ladder, operate a winch, manipulate a steering mechanism or actuate any other accessory feature that would be readily apparent to a person skilled in the art of designing and manufacturing toy vehicles.

It would be desirable if the user was able to actuate the accessory feature from a remote location as the additional autonomy of the toy vehicle would greatly enhance the enjoyment of playing with the vehicle. In order to allow the user to remotely actuate an accessory feature, the feature must be operatively linked to a power source that is provided on the toy vehicle. In most cases, it will be necessary to transmit mechanical power from a rotating power source (such as, for example, an electric motor) to the accessory feature.

Therefore, there is a need for a gearbox that can actuate an accessory feature from a remote location.

SUMMARY

One aspect of the present invention provides a gearbox that is adapted to permit a user to actuate an accessory feature from a remote location. The gearbox is adapted to transmit rotational power from a motor to a first drivetrain system adapted to drive a wheel and a second drivetrain system adapted to actuate an accessory feature. A swing mechanism is provided to alternatively translate rotational motion from the motor to the first drive train or the second drivetrain. In at least one embodiment, the swing mechanism includes a first spur gear which rotatably communicates with a second spur gear. When a motor drives the first spur gear in the first direction, the swing mechanism pivots such that the second spur gear engages a first crown gear. The first crown gear drives a first drivetrain system which, in turn, drives at least one drive wheel. When the motor drives the first spur gear in the second direction, the swing mechanism pivots such that the second spur gear engages a second crown gear, which drives a second drivetrain system to actuate an accessory feature.

In at least one embodiment, the present invention provides a gearbox for a toy vehicle, the gearbox comprising:

a motor;

a swing mechanism, said swing mechanism having a first spur gear and a second spur gear, said first spur gear rotatably communicating with said second spur gear, said motor adapted to drive said first spur gear in a first direction and a second direction;

a first crown gear, said first crown gear adapted to engage said second spur gear when the first spur gear is driven in the first direction, said first crown gear adapted to rotatably communicate with a first drivetrain system;

at least one drive wheel, said at least one drive wheel rotatably communicating with said first drivetrain system;

a second crown gear, said second crown gear adapted to engage said second spur gear when the first spur gear is driven in the second direction, said second crown gear rotatably communicating with a second drivetrain system;

an accessory feature, said accessory feature being adapted for communication with said second drivetrain system and being actuated by said communication with the second drivetrain system;

wherein when said motor drives said first spur gear in said first direction, said swing mechanism pivots such that said second spur gear engages said first crown gear, said first crown gear driving said first drivetrain system and said first drivetrain system driving said at least one drive wheel; and when said motor drives said first spur gear in said second direction, said swing mechanism pivots such that said second spur gear engages said second crown gear, said second crown gear driving said second drivetrain system and said second drivetrain system actuating said accessory feature.

BRIEF DESCRIPTION OF THE FIGURES

Preferred embodiments of the present invention will now be described in greater detail and will be better understood when read in conjunction with the following drawings in which.

DETAILED DESCRIPTION

Figure 1A:
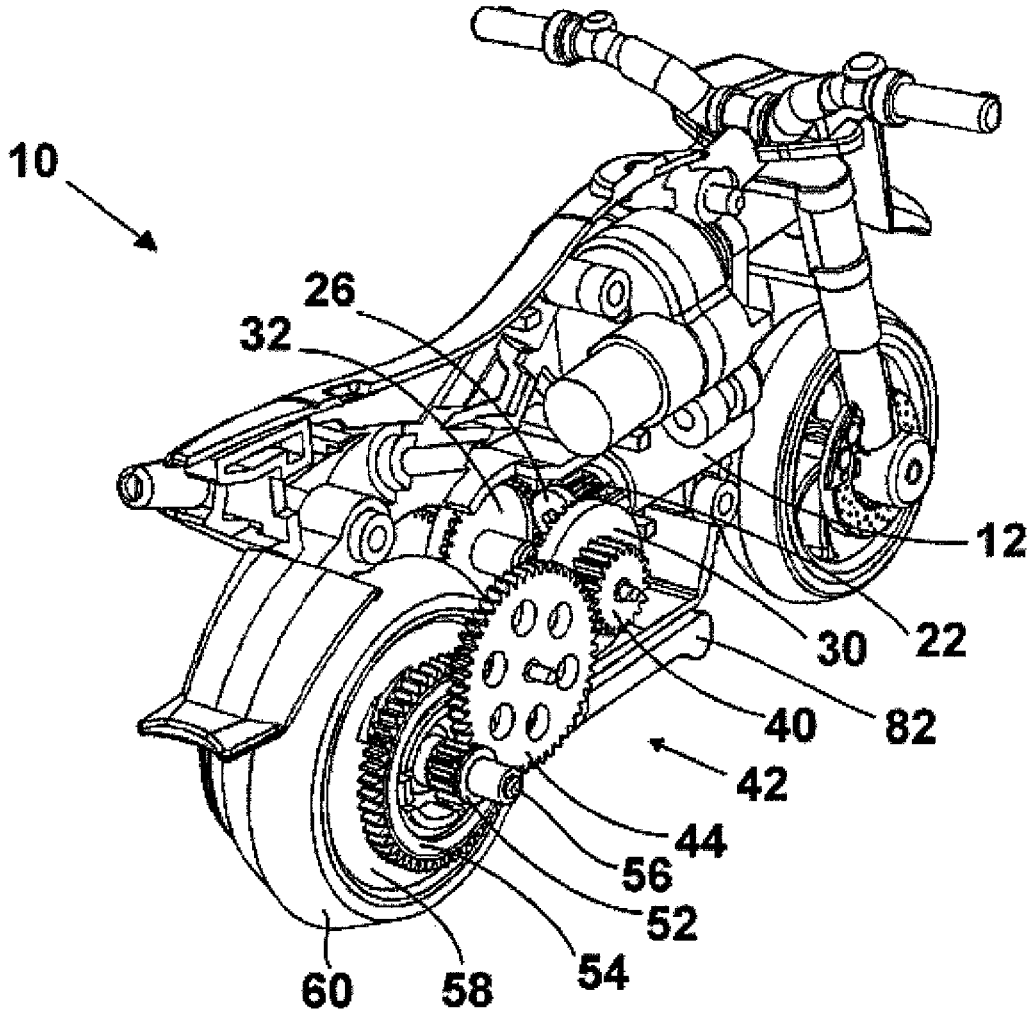
FIG. 1*a* is a rear perspective view of one embodiment of a gearbox embedded in a motorcycle-shaped housing in accordance with the present invention.
Figure 1B:
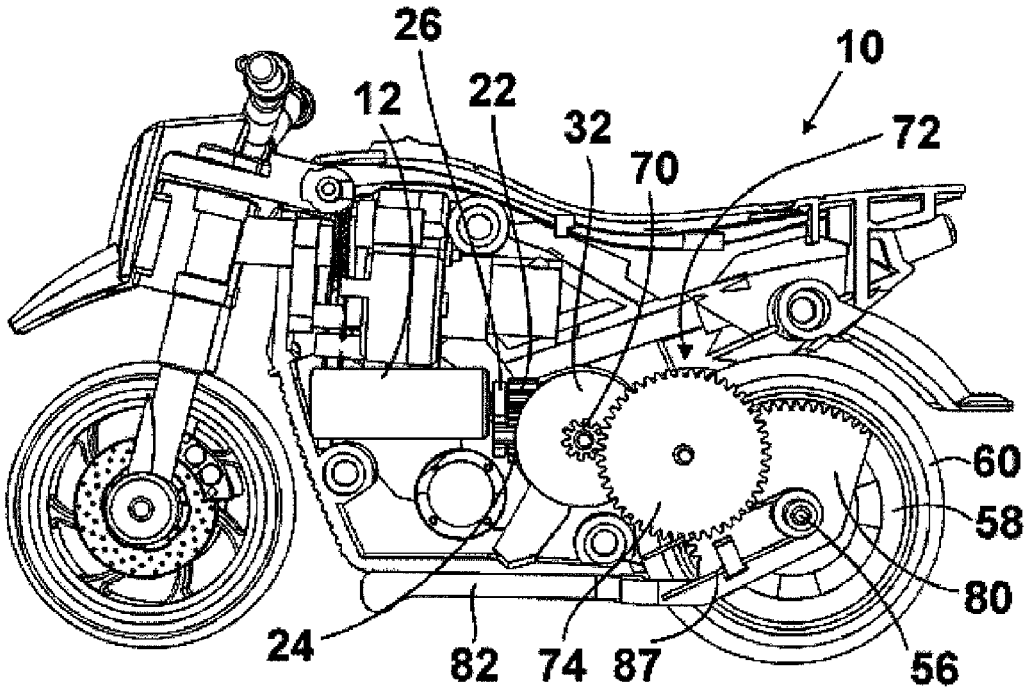
FIG. 1*b* is a side view of the gearbox of FIG. 1*a;*

The present invention provides a gearbox for a toy vehicle that is adapted to actuate an accessory feature. In at least one embodiment, the gearbox of the present invention can be mounted within the housing of a vehicle as shown in FIGS. 1*a* and 1*b*. This housing can take any desired shape provided that it provides adequate space to house and allow the present gearbox to operate. The housing could take the shape of a motorcycle, car, truck, tank, submarine, boat, among other shapes.

With reference to FIGS. 1 to 4, gearbox 10 is adapted to transmit rotational power from a motor 12 to an accessory feature. Motor 12 can take variety of forms provided that it can provide rotational power in both a clockwise and counterclockwise direction. In at least one embodiment, motor 12 is a DC electric motor, however it is also contemplated that motor 12 could be an AC electric motor or any other motor that is suitable for the application as will be understood by the person skilled in the art.

Figure 2A:
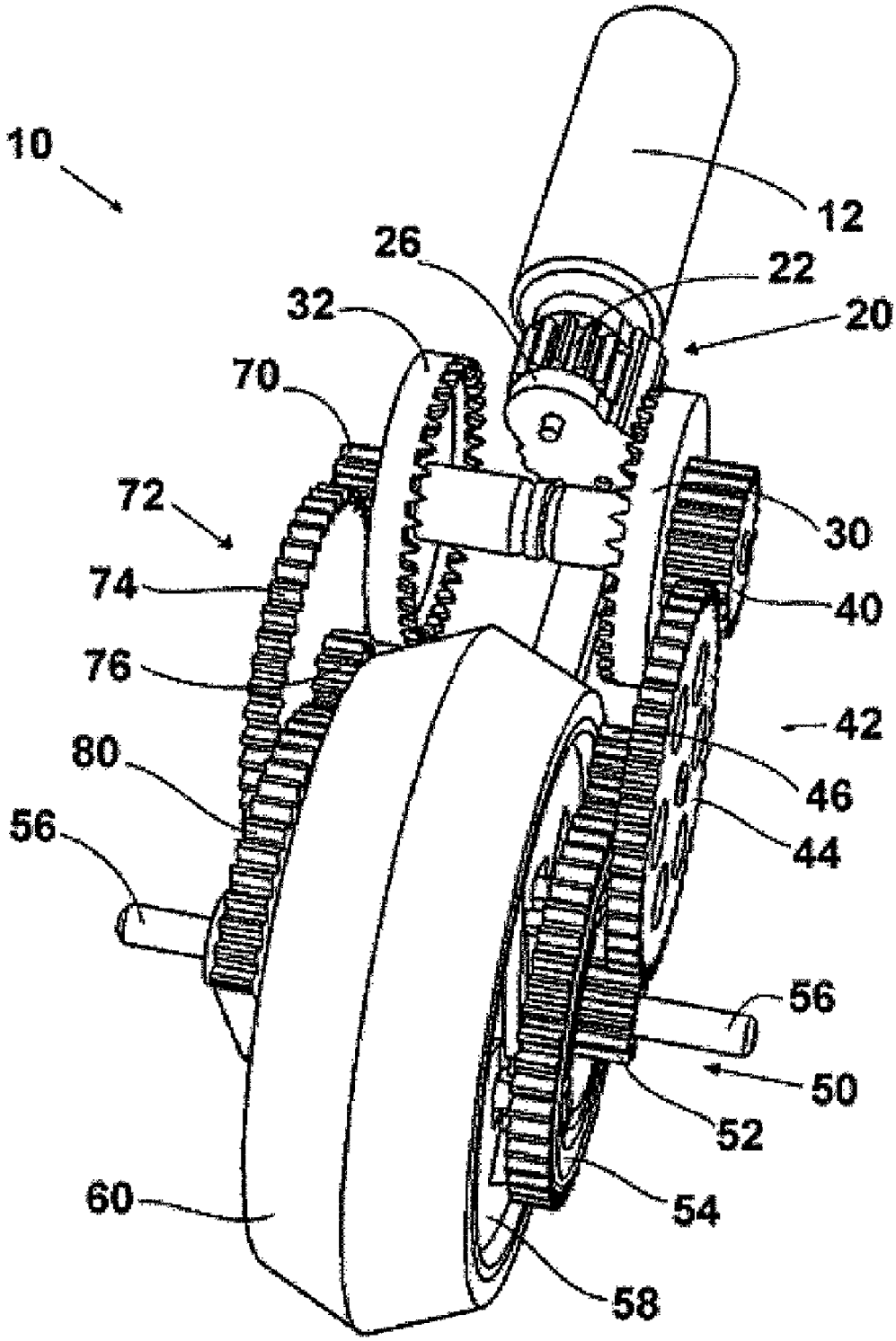
FIG. 2*a* is a rear perspective view of the gearbox of FIG. 1*a;*
Figure 2B:
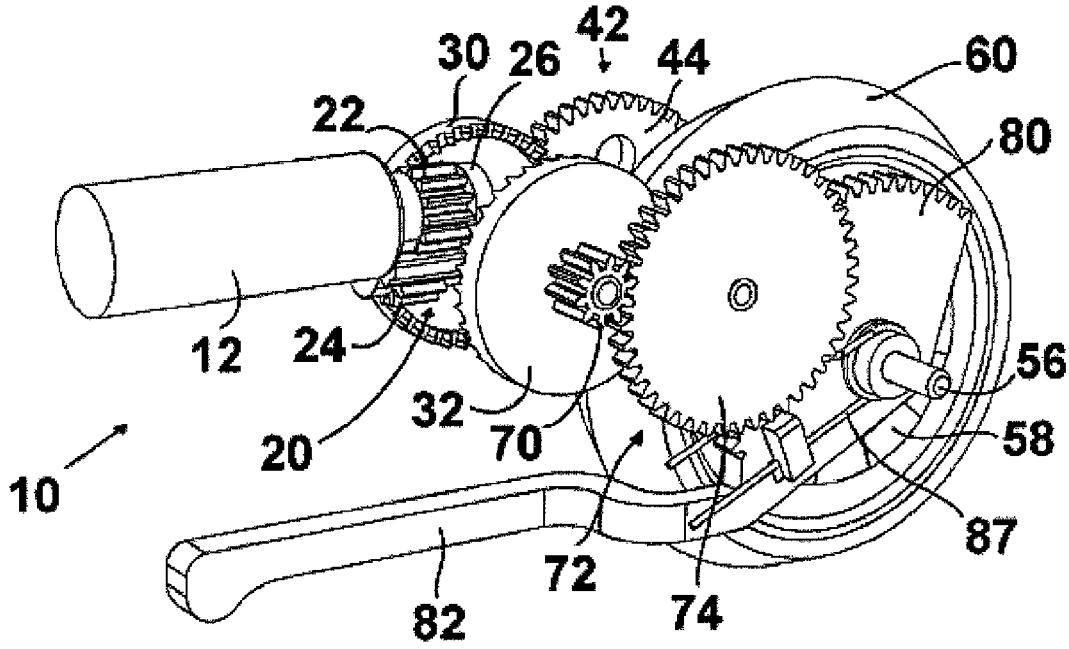
FIG. 2*b* is a side perspective view of the gearbox of FIG. 1*a;*
Figure 5:
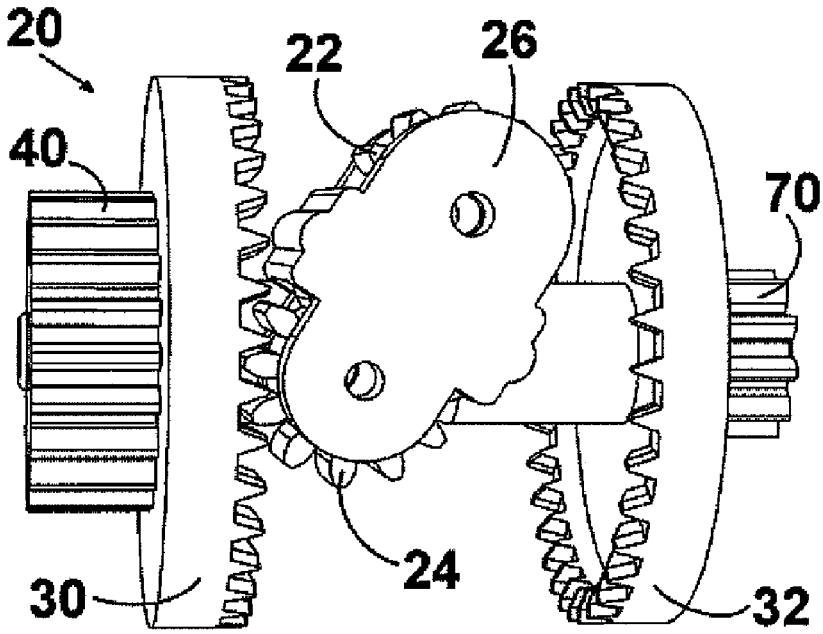
FIG. 5 is a front view of the swing mechanism of the gearbox of FIG. 1*a;*

Motor 12 is operatively linked to a swing mechanism 20. With reference to FIGS. 2*a*, 2*b* and 5, swing mechanism 20 consists of a first spur gear 22 and a second spur gear 24 that are housed in a swing mechanism housing 26. First spur gear 22 is oriented such that it rotationally communicates with second spur gear 24. Swing mechanism housing 26 provides that first spur gear 22 and second spur gear 24 rotate about parallel rotational axes. First spur gear 22 is coaxially linked to motor 12 such that rotational power is transmitted by first spur gear 22 from motor 12 to second spur gear 24.

As will be appreciated by the skilled person, when motor 12 is operated in a first direction (for example, clockwise), first spur gear 22 will accordingly be rotated in this first direction and second spur gear 24 is rotated in the opposite direction (i.e.: counterclockwise). Furthermore, the frictional interaction between first spur gear 22 and second spur gear 24 will in turn cause swing mechanism 20 to rotate in the same direction as first spur gear 22 (i.e.: clockwise). In a similar manner, when motor 12 is reversed in a second direction (i.e.: counterclockwise) first spur gear 22, second spur gear 24 and swing mechanism 20 are accordingly rotated in an opposite direction.

With reference to FIGS. 1 to 4, gearbox 10 has a first crown gear 30 and a second crown gear 32. In at least one embodiment, first crown gear 30 and second crown gear 32 rotate independently about the same rotational axis which is orthogonal to the axis of rotation of motor 12. First crown gear 30 is oriented such that when motor 12 is rotated in a first direction, swing mechanism 20 is rotated such that second spur gear 24 rotationally engages first crown gear 30. In a similar manner, when motor 12 is rotated in a second, opposite direction, swing mechanism 20 is rotated such that second spur gear 24 rotationally engages second crown gear 32.

First crown gear 30 is rotationally linked with a first drivetrain system and second crown gear 32 is rotationally linked with a second drivetrain system. The first and second drivetrain system can be any drivetrain system that is adapted to transmit rotational power, such as for example a chain and sprocket arrangement, mechanical gears, belt and pulley, among other arrangements.

The first drivetrain system is operatively linked to a drive wheel which will be discussed in greater detail below. The second drivetrain system is operatively linked to actuate an accessory feature which will also be discussed in greater detail below.

Figure 3:
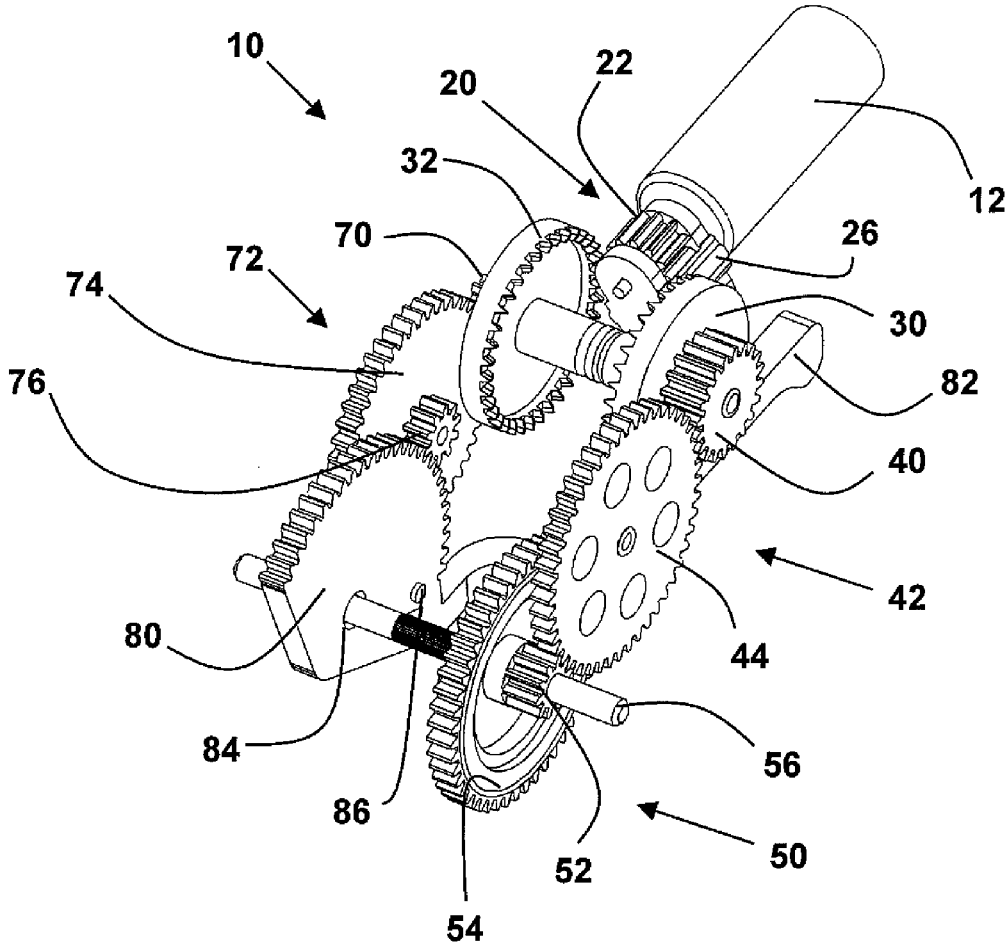
FIG. 3 is a rear perspective view of the gearbox of FIG. 1*a;*

With reference to FIGS. 1*a*, 2*a* and 3, in at least one embodiment the first drivetrain system consists of a small diameter first drive gear 40 that is coaxially fixed to first crown gear 30. First drive gear 40 is rotationally linked to an intermediate drive gearset 42 that includes a large diameter gear 44 that is coaxially fixed to a small diameter gear 46, as can also be seen in FIG. 4. First drive gear 40 rotationally drives large diameter gear 44, which in turn rotates small diameter gear 46. Small diameter gear 46 is rotationally linked to a main drive gear 50. Main drive gear 50 can be further operatively linked to any number of drive wheels by any suitable manner that will be readily understood by the skilled person.

With reference to FIG. 1*a*, in at least one embodiment main drive gear 50 consists of a flywheel drive gear 52 and a wheel drive gear 54. Flywheel drive gear 52 is coaxially aligned yet rotationally independent of wheel drive gear 54. Flywheel drive gear 52 is fixed to a flywheel drive axle 56 which is further linked to a flywheel 58. Wheel drive gear 54 is coaxially fixed to a wheel 60. In this embodiment, flywheel 58 is located within wheel 60, yet is rotationally independent of wheel 60.

As can be seen in FIG. 1*a*, flywheel drive gear 52 has a smaller diameter than wheel drive gear 54. Therefore as will be understood by the skilled person, when this embodiment of the first drivetrain is rotated by first crown gear 30, flywheel 58 is rotated faster than wheel 60. This embodiment is particularly well suited to applications where gearbox 10 is incorporated in a toy motorcycle, as flywheel 58 provides a significant moment of inertia which allows the toy motorcycle balance without the application of external forces.

The second drivetrain system is adapted to actuate an accessory feature. The accessory feature can take any form, provided that it can be actuated by the rotational power that is translated from the second crown gear by the second drivetrain system as will be readily understood by the skilled person. By way of non-limiting examples, the accessory feature could be a winch capable of being wound, a ladder capable of being extended and retracted, a projectile launcher or a hatch that can be selectively opened and closed. The accessory feature could be actuated by way of a standard spur gear, a rack gear, a sprocket and chain arrangement or a belt driven pulley, among other options that will be readily appreciated by the skilled person.

Figure 4:
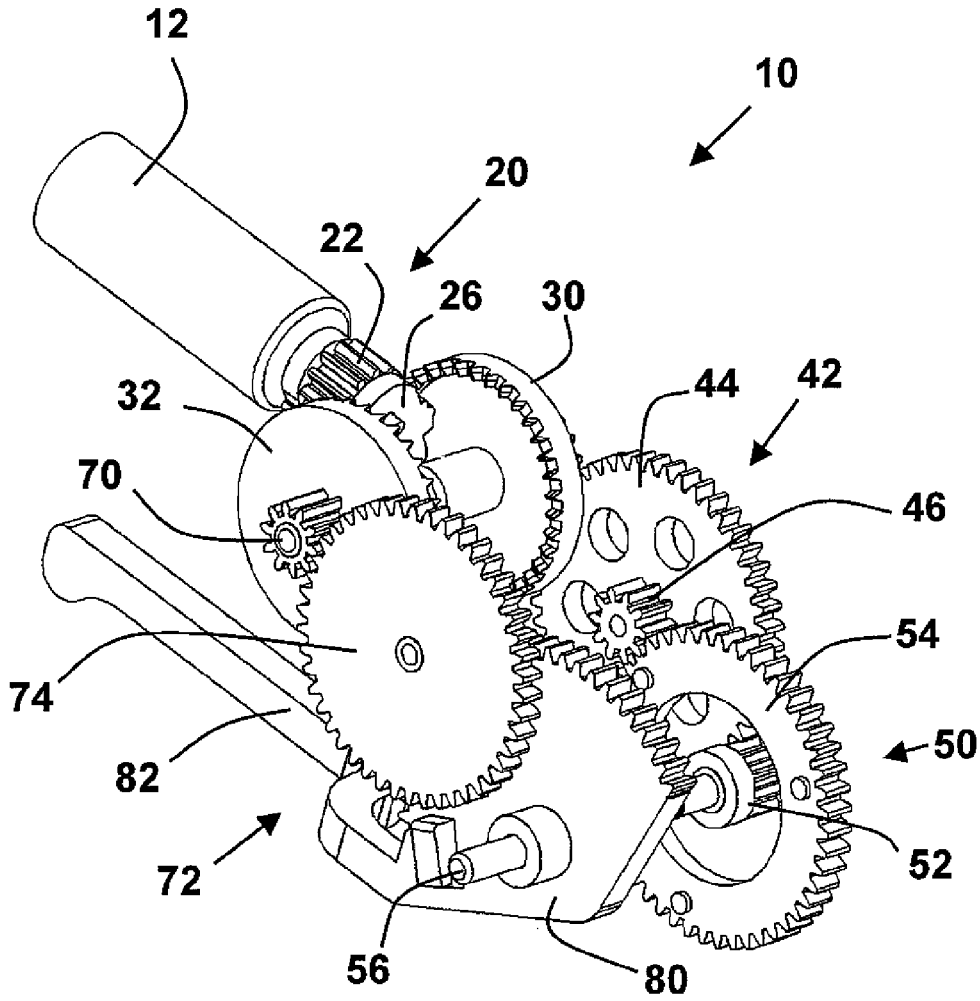
FIG. 4 is an alternate rear perspective view of the gearbox of FIG. 1*a;*

With reference to FIGS. 1*b*, 2*b* and 4, in at least one embodiment the second drivetrain system consists of a small diameter second drive gear 70 that is coaxially fixed to second crown gear 32. Second drive gear 70 is rotationally linked to an intermediate drive gearset 72 that is analogous to intermediate drive gearset 42 and includes a large diameter gear 74 that is coaxially fixed to a small diameter gear 76, seen in FIG. 3. Second drive gear 70 rotationally drives large diameter gear 74, which in turn rotates small diameter gear 76. In at least one embodiment, small diameter gear 76 is rotationally linked to an accessory feature in the form of an arcuate rack gear 80. Arcuate rack gear 80 can further consist of an accessory lever 82 that extends outwardly from arcuate rack gear 80.

Figure 6:
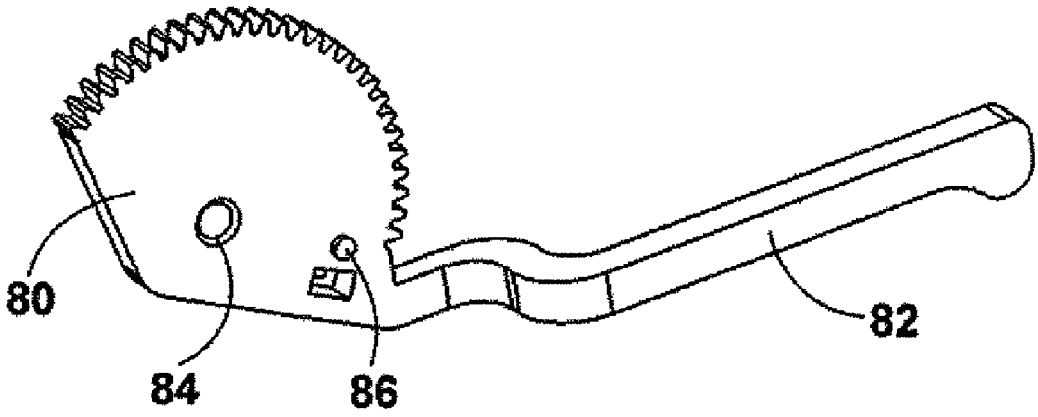
FIG. 6 is a side perspective view of an arcuate rack gear in accordance with one embodiment of the present invention.
Figure 7:
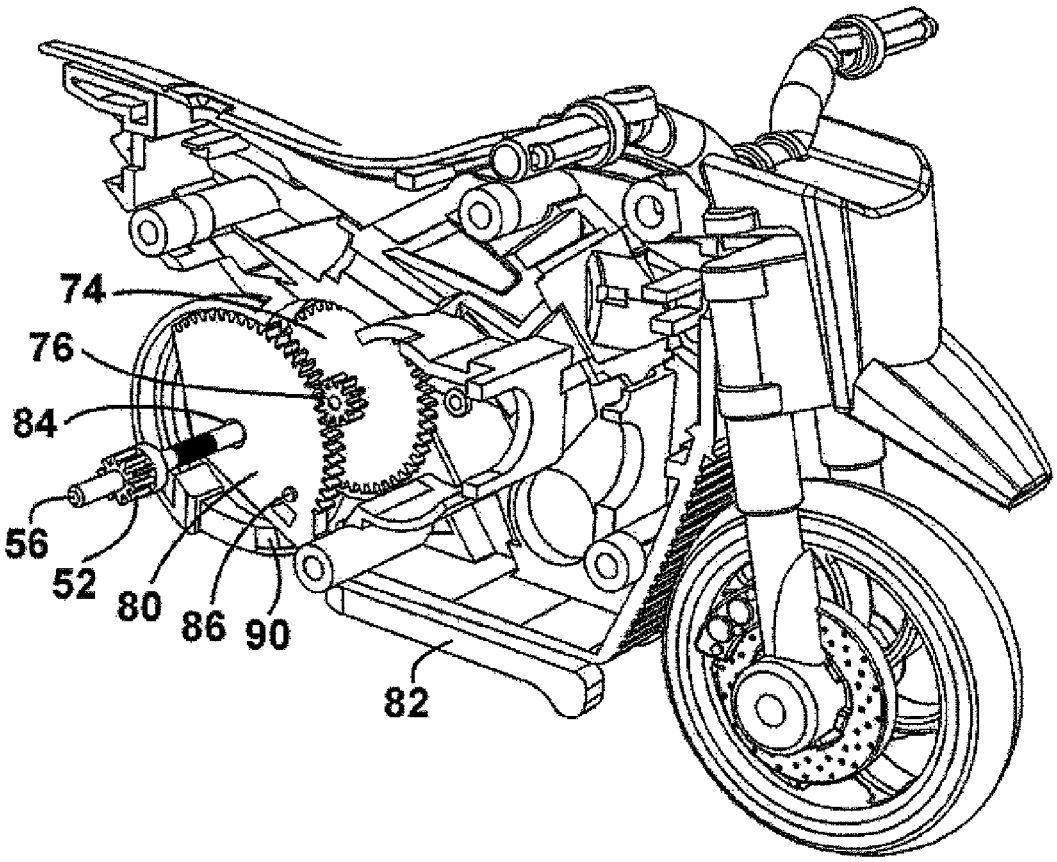
FIG. 7 is a cutaway side perspective view of the gearbox of FIG. 1*a* embedded in a motorcycle-shaped housing.

In at least one embodiment and as can be seen in FIGS. 3, 6 and 7, arcuate rack gear 80 consists of central hole portion 84 and a brake 86. Central hole portion 84 provides an opening wherein the arcuate rack gear 80 can be pivotably mounted to the structure of the toy vehicle. In at least one embodiment, central hole portion 84 is pivotably mounted on drive axle 56.

In this way, rotational power can be translated from motor 12 to actuate the accessory. In at least one embodiment, motor 12 is rotated in a second direction for a predetermined period of time, causing swing mechanism 20 to swing to engage second spur gear 24 with second crown gear 32. Second crown gear 32 in turn rotates second drive gear 70 (which is coaxially fixed to second crown gear 32) and second drive gear 70 rotationally engages intermediate drive gearset 72 by meshing with large diameter gear 74. Small diameter gear 76 in turn rotationally engages arcuate rack gear 80, causing arcuate rack gear 80 to rotate and outwardly extend accessory lever 82. At the end of the predetermined period, the motor 12 returns to rotation in the first direction, causing swing mechanism 20 to swing out of engagement with second crown gear 32, so that the actuation of the second drivetrain system is halted. Swing mechanism 20 then re-engages second spur gear 24 with first crown gear 30 so as to drive the first drivetrain system as described above.

As will be understood by the skilled person, arcuate rack gear 80 can travel a maximum distance before arcuate rack gear 80 will become disengaged from small diameter gear 76.

In the other words, the maximum distance that arcuate rack gear 80 can travel is limited to the length of the line of contact between small diameter gear 76 and arcuate rack gear 80. Therefore, motor 12 can only be rotated in the second direction (thereby engaging second drivetrain system) for a period of time that permits arcuate rack gear 80 to travel its maximum distance. This maximum distance will typically correspond to less than one rotation of arcuate rack gear 80 about hole portion 84.

In at least one embodiment and as discussed above, arcuate rack gear 80 is provided with accessory lever 82, as can be seen in FIG. 6. Accessory lever 82 can be adapted to accomplish a number of functions, such as raise a boom, open a door, or pull on a string. In at least one embodiment, accessory lever 82 can be oriented on the bottom of the toy vehicle such that when arcuate rack gear 80 is engaged and accessory lever 82 is extended, the toy vehicle raises up into a "wheelie" position, as will be readily understood by the skilled person. The vehicle then balances on its rear wheel and rear fender, and the accessory lever 82 returns to its unextended position under the bias of spring 87. Once the vehicle has achieved a wheelie position, motor 12 is reversed to the first direction so that swing mechanism 20 engages the first drivetrain system which drives the vehicle forward in the wheelie position.

In embodiments wherein the accessory feature is adapted to raise the toy vehicle into a wheelie position, the housing can provide a sloped surface 90 that is located adjacent arcuate rack gear 80 as can be seen in FIG. 7. When the user desires to disengage the toy vehicle from the wheelie position, the motor can be reversed once again into the second position, for example, by actuation by a remote control. It is contemplated that the reversal of the motor to disengage the toy vehicle from the wheelie position can be controlled by the operator of the toy vehicle, or alternatively, for example, it can be programmed to occur at random or at a predetermined time interval. When the second drivetrain is re-engaged, arcuate rack gear is again urged forward for a predetermined period of time. However, because the vehicle is in a wheelie position, the accessory lever 82 need not be pushed against the ground. Therefore, the second drivetrain encounters a reduced load and pushes the outer edge of arcuate rack gear 80 to contact sloped surface 90 which urges arcuate rack gear 80 laterally and inwardly towards wheel 60. As arcuate rack gear 80 approaches wheel 60, brake 86 contacts wheel 60. As will be understood by the skilled person, the frictional contact between brake 86 and wheel 60 slows wheel 60 sufficiently to urge the toy vehicle out of the wheelie position.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

I claim:

1. A gearbox for a toy vehicle, the gearbox comprising:

a motor;

a swing mechanism, said swing mechanism having a first spur gear and a second spur gear, said first spur gear rotatably communicating with said second spur gear, said motor adapted to drive said first spur gear in a first direction and a second direction;

a first crown gear, said first crown gear adapted to engage said second spur gear when the first spur gear is driven in the first direction, said first crown gear adapted to rotatably communicate with a first drivetrain system;

at least one drive wheel, said at least one drive wheel rotatably communicating with said first drivetrain system;

a second crown gear, said second crown gear adapted to engage said second spur gear when the first spur gear is driven in the second direction, said second crown gear rotatably communicating with a second drivetrain system;

an accessory feature, said accessory feature being adapted for communication with said second drivetrain system and being actuated by said communication with the second drivetrain system;

wherein when said motor drives said first spur gear in said first direction, said swing mechanism pivots such that said second spur gear engages said first crown gear, said first crown gear driving said first drivetrain system and said first drivetrain system driving said at least one drive wheel; and when said motor drives said first spur gear in said second direction, said swing mechanism pivots such that said second spur gear engages said second crown gear, said second crown gear driving said second drivetrain system and said second drivetrain system actuating said accessory feature.

2. The gearbox of claim 1 wherein said first drivetrain system comprises a series of rotatably communicating gears.

3. The gearbox of claim 1 wherein said second drivetrain system comprises a series of rotatably communicating gears.

4. The gearbox of claim 1 wherein said accessory feature comprises an arcuate rack gear.

5. The gearbox of claim 4 wherein said arcuate rack gear further comprises an accessory lever.

6. The gearbox of claim 4 further comprising a vehicle housing adapted to receive the gearbox.

7. The gearbox of claim 6, wherein said arcuate rack gear further comprises a brake adapted to impart friction on said at least one drive wheel and said vehicle housing further comprises a ramp surface adapted to engage said arcuate rack gear such that said arcuate rack gear is displaced laterally towards said at least one drive wheel, said brake contacting said at least one drive wheel.

8. The gearbox of claim 6 wherein said housing is provided in the shape of a motorcycle.

9. The gearbox of claim 1 wherein said motor is an electric motor.

10. The gearbox of claim 1 wherein said first drivetrain system further comprises a main drive gear, said main drive gear adapted to communicate with said at least one drive wheel.

11. The gearbox of claim 10 wherein said at least one drive wheel comprises a flywheel, said flywheel being rotatably independent from said at least one drive wheel, said flywheel located inside said at least one drive wheel; and wherein said main drive gear comprises a wheel drive gear and a flywheel drive gear, said wheel drive gear being rotationally independent of said flywheel drive gear, said wheel drive gear rotatably communicating with said at least one drive wheel, and said flywheel drive gear rotatably communicating with said flywheel.

* * * * *